United States Patent [19]

Brown

[11] Patent Number: 4,919,593

[45] Date of Patent: Apr. 24, 1990

[54] RETROFITTED ROTOR BLADES FOR STEAM TURBINES AND METHOD OF MAKING THE SAME

[75] Inventor: Wilmott G. Brown, Winter Park, Fla.

[73] Assignee: Westinghouse Electric Corp., Pittsburgh, Pa.

[21] Appl. No.: 238,439

[22] Filed: Aug. 30, 1988

[51] Int. Cl.[5] ..... F04D 29/38

[52] U.S. Cl. ..... 416/223 A; 416/196 R; 416/500; 416/DIG. 2; 416/181; 29/889.7

[58] Field of Search ..... 416/223 A, DIG. 2, 500, 416/196 R, 194; 415/181; 29/156.8 B, 156.8 R

[56] References Cited

U.S. PATENT DOCUMENTS 1,544,318 6/1925 Hodgkinson ..... 416/196

3,412,611 11/1968 Eccles et al. ..... 416/196

3,653,110 4/1972 King, Jr. et al. ..... 29/156.8 B

*Primary Examiner*—Robert E. Garrett

*Assistant Examiner*—John T. Kwon

[57] ABSTRACT

A retrofitted rotor blade having a longer length than an original rotor blade provided for a steam turbine rotor assembly has a tuned airfoil portion with natural resonant frequencies in a plurality of vibrational directions similar to the original rotor blade. Since lengthening the blade causes a decreased and resonant frequency, a unique combination of tuning techniques raises the resonant frequencies to the required levels. The tip of the retrofitted rotor blade is profiled to increase the natural resonant frequency in the second mode of vibration, which is in the axial direction of the rotor.

7 Claims, 4 Drawing Sheets

FIG. 1
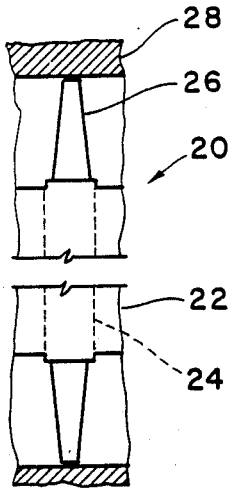
FIG. 5
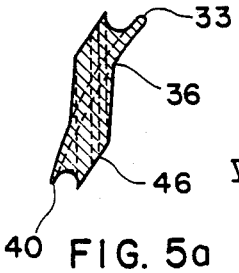
FIG. 5a
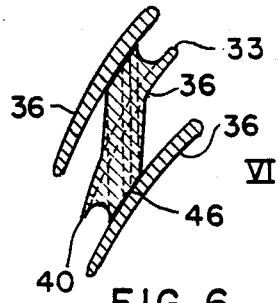
FIG. 2
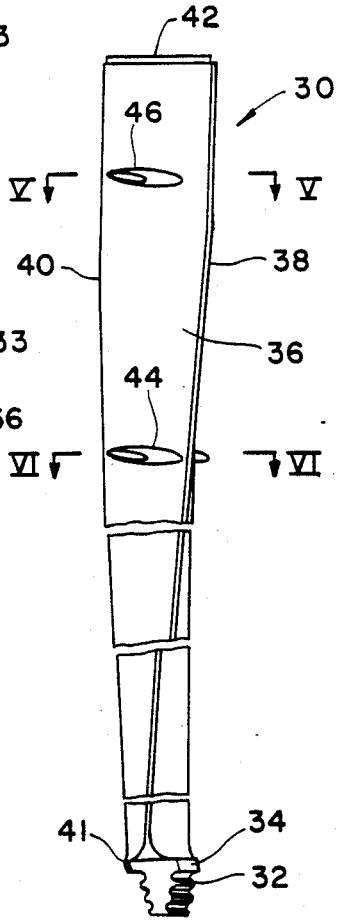
FIG. 6
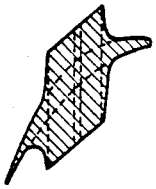
FIG. 7
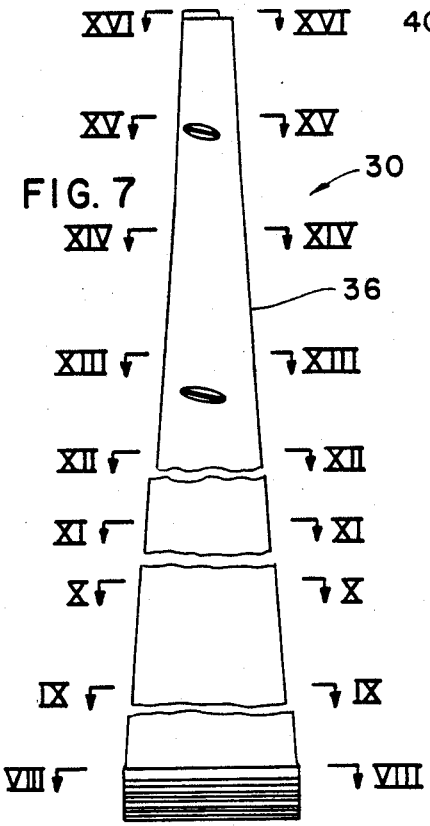
FIG. 4
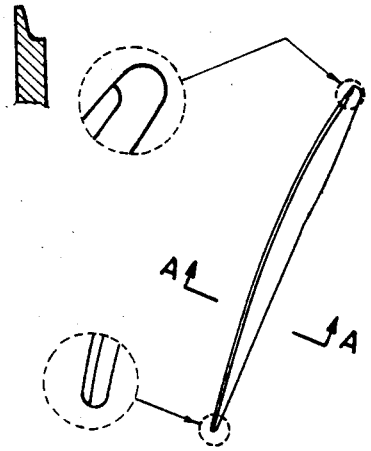
FIG. 3

1/2

5/8

RETROFITTED ROTOR BLADES FOR STEAM TURBINES AND METHOD OF MAKING THE SAME

BACKGROUND OF THE INVENTION

1. Field of the Invention

The present invention relates generally to steam turbine rotor blades and, more particularly, to a retrofitted rotor blade for a pre-existing steam turbine and method of designing the same.

2. Description of the Related Art

Steam turbine rotor blades are arranged in a plurality of rows or stages. The rotor blades of a given row are identical to each other and mounted in a mounting groove provided in the turbine rotor.

Turbine rotor blades typically share the same basic shape. Each has a root receivable in the mounting groove of the rotor, a platform which overlies the outer surface of the rotor at the upper terminus of the root, and an airfoil which extends upwardly from the platform.

The airfoils of most steam turbine rotor blades include a leading edge, a trailing edge, a concave surface, a convex surface, and a tip at the distal end opposite the root. The airfoil shape common to a particular row of rotor blades differs from the airfoil shape for every other row within a particular turbine. Likewise, no two turbines of different designs share airfoils of the same shape. The structural differences in airfoil shape result in significant variations in aerodynamic characteristics, stress patterns, operating temperature, and natural frequency of the airfoil. These variations, in turn, determine the operating life of the rotor blades within the boundary conditions (turbine inlet temperature, compressor pressure ratio, and engine speed), which are generally determined prior to air foil shape development.

Development of a turbine section for a new commercial, power generation steam turbine may require several years to complete. When designing rotor blades for a new steam turbine, a profile developer is given a certain flow field with which to work. The flow field is determined by the inlet and outlet angles (for steam passing between adjacent rotor blades of a row), gauging, and the velocity ratio, among other things. "Gauging" is the ratio of throat to pitch; "throat" is the straight line distance between the trailing edge of one rotor blade and the vacuum-side surface of an adjacent blade, and "pitch" is the distance between the trailing edges of adjacent rotor blades.

These flow field parameters are dependent on a number of factors, including the length of the rotor blades of a particular row. The length of the blades is established early in the design stages of the steam turbine and is essentially a function of the overall designed power output of the steam turbines and the power output for that particular stage.

An essential aspect of rotor blade design is the "tuning" of the resonant frequency of the rotor blade so as to avoid resonant frequencies which coincide with or approximate the harmonics of running speed. Such coincidence causes the blades to vibrate in resonance, thereby leading to blade failure. Therefore, in the process of designing and fabricating turbine rotor blades, it is critically important to tune the resonant frequencies of the blades to minimize forced or resonant vibration.

To do this, the blades must be tuned to avoid the "harmonics of running speed".

The harmonics of running speed is best explained by example. In a typical fossil fuel powered steam turbine, the rotor rotates at 3,600 revolutions per minute (rpm), or 60 "cycles" per second (cps). Since one cps equals 1 hertz (Hz), and since simple harmonic motion can be described in terms of the angular frequency of circular motion, the running speed of 60 cps produces a first harmonic of 60 Hz, a second harmonic of 120 Hz, a third harmonic of 180 Hz, a fourth harmonic of 240 Hz, etc. Blade designers typically consider frequencies up to the seventh harmonic (420 Hz). The harmonic series of frequencies, occurring at intervals of 60 Hz, represents the characteristic frequencies of the normal modes of vibration of an exciting force acting upon the rotor blades. If the natural frequencies of oscillation of the rotor blades coincide with the frequencies of the harmonic series, or harmonics of running speed, a destructive resonance can result at one or more of the harmonic frequencies.

Given that exciting forces can occur at a series of frequencies, a blade designer must ensure that the natural resonant frequencies of the blades do not fall on or near any of the frequencies of the harmonic series. This would be an easier task if rotor blades were susceptible to vibration in only one direction. However, a rotor blade is susceptible to vibration in potentially an infinite number of directions. Each direction of vibration will have a different corresponding natural resonant frequency. The multi-directional nature of blade vibration is referred to as the "modes of vibration". For a row of lashed rotor blades, up to at least seven different modes or directions of vibration are considered. Each mode of vibration establishes a different natural resonant frequency for a given rotor blade for a given direction.

The first mode of vibration is a tangential vibration in the rotational direction of the rotor, and is substantially influenced by the position of the lower of the two lashing wires used to interconnect a group of rotor blades. Lowering the position of the lower lashing wire tends to increase the resonant frequency for the first mode of vibration. The second mode of vibration is a tangential vibration in the axial direction of the rotor. The position of the lower lashing wire tends to have an inverse effect on the second mode frequency such that, as the lower wire is lowered to raise the frequency in the first mode, the frequency of the second mode falls. The third mode of vibration is vibration in the "X" direction such that displacement occurs in the axial direction of a wired group of blades. The third mode of vibration is highly dependent on the number of blades per group; the frequency is lowered with the addition of more blades in the group. As an example, viewing three blades lashed together in a group from the top, a third mode vibration would involve displacement of the outer two blades in opposite directions from the axial line of the three blades. The middle blade would have zero displacement. As the blades vibrate, the outer two blades reverse displacement in a vibratory fashion. In this respect, the third mode of vibration is a twisting or torsional type of vibration. The fourth mode of vibration is an in-phase vibration which is highly dependant upon on the positioning of the outer-most lashing wire; moving the outer-most lashing wire downwardly lowers the frequency in the fourth mode.

Modes of vibration beyond the fourth mode become increasingly complex. The fifth mode is considered a second "X" direction vibration, while the sixth mode is in a "U" direction, such that in the example of three blades lashed together, the U-directional vibration would involve displacement of the outer blades in the same direction and displacement of the center blade in the opposite direction. The seventh mode of vibration is another in-phase vibration.

When tuning lashed rotor blades, it is important to tune the blades with respect to the first three modes of vibration. Keeping in mind the harmonic series described above for a fossil fuel powered steam turbine operating at 3,600 rpm the natural resonant frequency for a rotor blade must be tuned to avoid frequencies at intervals of 60 Hz. For example, the second harmonic occurs at 120 Hz and the third harmonic occurs at 180 Hz. The standard practice is to attempt to tune the blade having a frequency falling somewhere between 120–180 Hz to come as close as possible to the mid point between the two harmonics, i.e., 150 Hz. It is not unusual to have a rotor blade having a natural resonant frequency which falls between the second and third harmonics for the first mode of vibration. Therefore, it is desireable to tune the blade to have a frequency at or near 150 Hz for the first mode of operation.

Frequencies for the second and third modes of vibration are similarly tuned to be as close as possible to a midpoint between two successive harmonics. However, frequency tests are commonly run up to and beyond the seventh mode of vibration. With respect to the fourth mode of vibration, a frequency near the seventh harmonic (420 Hz) might be expected; therefore, the outermost lashing wire should be positioned to make sure that the resonant frequency for the fourth mode of vibration is sufficiently above the seventh harmonic.

When a new steam turbine is designed, the blade designer must tune the turbine blades so that none of the resonant frequencies for any of the modes of vibration coincide with the frequencies associated with the harmonics of running speed. Sometimes, tuning requires a trade off with turbine performance or efficiency. For instance, certain design changes may have to be made to the blade to achieve a desired resonant frequency in a particular mode. This may necessitate an undesirable change elsewhere in the turbine such as a change in the velocity ratio or a change in the pitch and width of the blade root.

A difficult problem arises in the situation where a pre-existing turbine is upgraded to increase its power output. This may be done by increasing the length of the blades of one or more rows, and boring out the cylinder around the row to accommodate the greater overall length. The new, longer blade would have to have substantially the same root to avoid having to replace the rotor. As a result of blade lengthening, such as from a 25 inch blade to a 26 inch blade, the originally designed and meticulously calculated flow field changes so that a redesign of the longer blade is necessary. This is more difficult than designing an original blade since the pre-existing turbine establishes non-variable or restricted design parameters. For instance, for every radial cross-section passing through two adjacent rotor blades, the concave surface of one of the rotor blades must converge with the convex, opposing surface of the other rotor blade, with the convergence being from the leading edge to the trailing edge. This must be done while maintaining a velocity ratio at or below a certain level. Also, as previously mentioned, the root cannot be altered.

Another particularly difficult problem with a retrofitted, longer blade for a pre-existing turbine is that, while the harmonics of running speed do not change, the natural resonant frequencies for all modes of vibration are decreased as a result of the blade lengthening. The resonant frequencies must be increased by tuning techniques which do not hamper performance or efficiency to an unacceptable degree.

SUMMARY OF THE INVENTION

An object of the invention is to increase a thermal performance of a steam turbine by increasing the power output of at least one stage.

Another object of the invention is to increase the reliability of a steam turbine by increasing overall performance.

Another object of the invention is to increase the length of a rotor blade for a given row in a steam turbine and simultaneously increase the natural resonant frequencies of the longer blade which naturally tend to decrease as a result of the lengthening.

Yet another object of the invention is to redesign an airfoil portion of a rotor blade without redesigning the root portion.

In a preferred embodiment described herein, a steam turbine rotor assembly includes a rotor rotatable at a predetermined running speed which determines a harmonic series of vibratory frequencies, and at least one row of retrofitted rotor blades, each having a length greater than that of the rotor blades which were originally designed for the same row, wherein the rotor blades are lashed together in groups of at least three rotor blades per group by means of an upper and lower lashing wire extending between each two adjacent retrofitted rotor blades of a group, wherein the configuration of the airfoil portion of the rotor blade being defined in accordance with a plurality of equidistantly spaced plane slices beginning at the base and ending at the tip, the area between two adjacent plane slices defining a plurality of sections of the airfoil portion, each section having a center of gravity, wherein the centers of gravity for all sections are vertically aligned, the upper and lower lashing wires of the retrofitted rotor blades being positioned at an upper portion of the airfoil portion, the lower lashing wire having an increased thickness compared to the lower lashing wire of the original rotor blades, at least one of the sections of the airfoil portion of the retrofitted blade nearest the root having an increased width compared to correspondingly located sections of the original rotor blade, and at least one of the sections of the airfoil portion of the retrofitted rotor blade nearest the tip having a reduced width compared to correspondingly located sections of the original rotor blade, the tip of the retrofitted rotor blade being profiled to reduce weight and thickness, the tip section of the airfoil portion of each retrofitted rotor blade and the section next to the tip having pressure-side and vacuum-side surfaces which are convex, and the remaining sections having concave pressure-side surfaces and convex vacuum-side surfaces, the position and thickness of the lower lashing wire, the number of blades in the lashed group, the width of the sections of the airfoil portion, and the profiled tip combine to increase the rotor blade natural resonant frequencies for a plurality of modes of vibration to frequency levels which fall between the frequencies of the harmonic series, thereby compensating for a decrease in resonant frequency associated with the lengthening of the retrofitted rotor blade.

These and other features and advantages of the retrofitted rotor blades and method of making the same will become more apparent with reference to the following detailed description and drawings.

BRIEF DESCRIPTION OF THE DRAWINGS

FIG. 1 is a schematic representation of a row of steam turbine rotor blades according to a preferred embodiment of the present invention;

FIG. 2 is a front elevation view of a rotor blade according to a preferred embodiment of the present invention;

FIG. 3 is a top view of the rotor blade of FIG. 2;

FIG. 4 is a cross-sectional view taken along lines A—A of FIG. 3;

FIG. 5 is a cross-sectional view taken along lines V—V of FIG. 2; FIG. 5*a* is a top view of three blades lashed together.

FIG. 6 is a cross-sectional view taken along lines VI—VI of FIG. 2;

FIG. 7 is a side view of the rotor blade of FIG. 2;

DETAILED DESCRIPTION OF THE PREFERRED EMBODIMENTS

Figure 8:
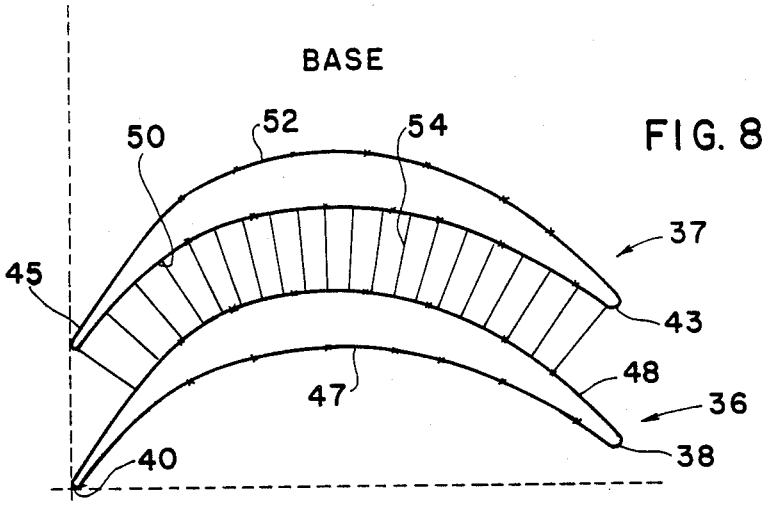
FIG. 8 is a plane slice through a section VIII—VIII of FIG. 7 and further shows two adjacent rotor blades and lines of convergence between opposing surfaces of the two adjacent rotor blades.

While a basic shape of the airfoil portion of a lengthened, retrofit blade will be determined by the inlet and outlet conditions and can be generated by a computer graphics program, the final shape is a result of a process which requires engineering judgment derived from a thorough understanding and creative application of the underlying physical principles associated with blade design and tuning.

FIG. 1 shows a rotor assembly 20 which includes a rotor 22 and a row 24 of rotor blades 26. A typical row 24 has 120 rotor blades 26 mounted radially around the rotor 22 in mounting grooves (not shown). The tips of each rotor blade 26 extends to an inner surface of a steam turbine cylinder 28 which supports a plurality of stationary blade rows (not shown).

The longer retrofitted blade for row 24 will require boring out of the cylinder 28 to accommodate the greater overall radial length of the rotor blades. Typically, a steam turbine cylinder 28 is made in two semicylindrical parts which can be disassembled for removing the rotor and the original, shorter rotor blades mounted thereon.

Due to the longer blade length required for upgrading the steam turbine, the flow field must be re-calculated. This requires re-designing the blade 26 to match the new flow field. As previously mentioned, special problems are encountered in that some of the design parameters are non-variable. For instance, the root of the blade has to remain the same to be fitted onto the existing rotor 22. Also, the natural resonant frequency of the rotor blade 26 is decreased for the various modes of vibration. The resonant frequencies cannot easily be increased since tuning techniques used to increase the resonant frequency for one mode may decrease the frequency in another mode. This is particularly true for wired blades, as opposed to free standing blades.

Referring to FIGS. 2–6, a retrofitted rotor blade 30 has a root portion 32 for mounting the retrofitted blade 30 in a corresponding mounting groove of the rotor 22. A platform portion 34 is formed at the upper terminus of the root portion 32 and supports the airfoil portion 36. The airfoil portion 36 has a leading edge 38, a trailing edge 40, a proximal end base 41 and a distal end tip 42. A lower wire 44 and an upper wire 46 are used to lash together a group of adjacent rotor blades within a row. Preferably, three blades are wired together with wires 44 and 46. The number of blades in a group is important because the natural resonant frequency in the third mode of vibration is heavily influenced by the blade grouping.

Once the new flow field is generated, a computer program is used to provide a basic design for the retrofitted rotor blade having a longer length. In order to achieve proper performance, the basic design must be reshaped to maintain convergence of opposing surfaces between two adjacent airfoil portions 36. Also, the natural resonant frequency of the rotor blade for the various vibrational modes must be increased.

Referring now to FIG. 7, the airfoil portion 36 of the rotor blade 30 is divided into nine plane slices VIII—VIII through XVI—XVI. Each of these slices is redesigned starting from the base slice VIII—VIII and progressing successively outwardly towards the tip slice XVI—XVI.

Referring to FIGS. 8–16, the plane slices described above with respect to FIG. 7 are shown for two adjacent airfoil portions 36 and 37 of two adjacent rotor blades of a row. Airfoil portion 36 has a leading edge 38 and a trailing edge 40. Airfoil portion 37 has a leading edge 43 and a trailing edge 45. Airfoil portion 36 has a pressure-side surface 47 and a vacuum-side surface 48, while airfoil portion 37 has a pressure-side surface 50 and a vacuum-side surface 52. Pressure-side surface 50 of airfoil portion 37 opposes the vacuum-side surface 48 of airfoil portion 36. FIGS. 9–16 illustrate similar features for other slices. A plurality of reference lines 54 extending perpendicularly between opposing surfaces illustrate that the distance between the pressure-side surface 50 and the vacuum-side surface 48 constantly decreases from the leading edge 43 to the trailing edge 45 of airfoil portion 37. Thus, from the leading edge to the trailing edge, opposing surfaces of adjacent blades converge. This is true for all plane slices.

Figure 9:
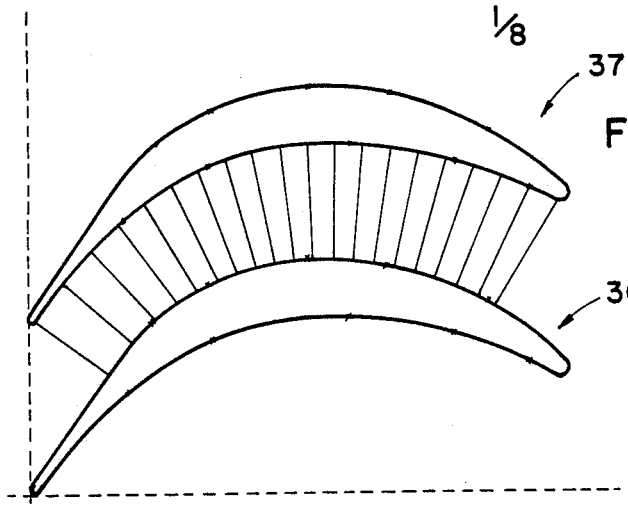
FIG. 9 is a view similar to FIG. 8 except taken along section IX—IX of FIG. 7.
Figure 10:
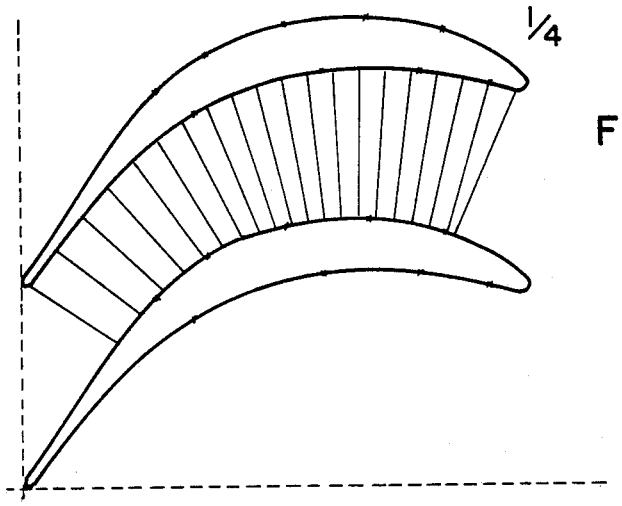
FIG. 10 is a view similar to FIG. 8 except taken along section X—X of FIG. 7.
Figure 11:
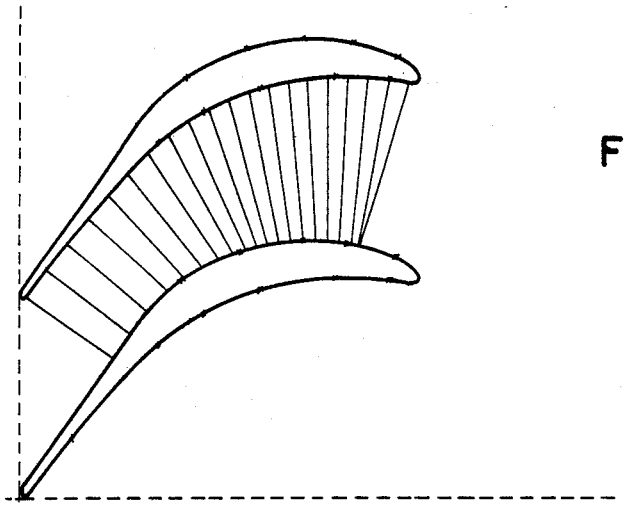
FIG. 11 is a plane slice view similar to FIG. 8 except taken along section XI—XI of FIG. 7.
Figure 12:
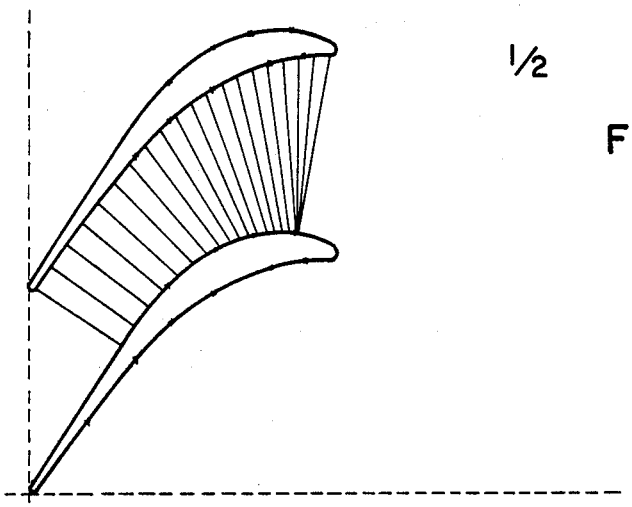
FIG. 12 is a plane slice view similar to FIG. 8 except taken along section XII—XII of FIG. 7.
Figure 13:
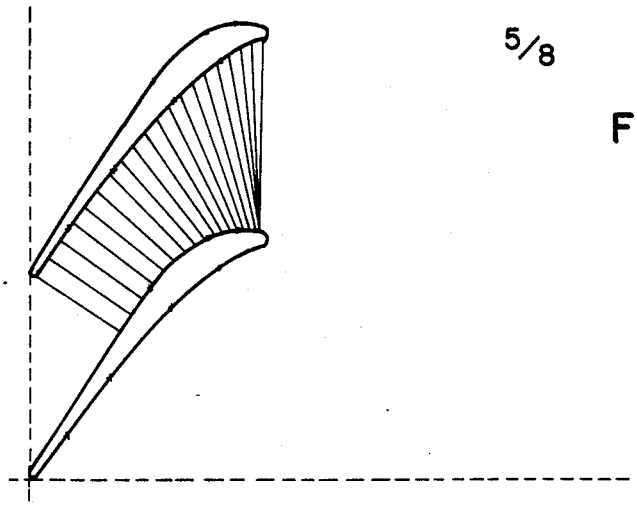
FIG. 13 is a plane slice view similar to FIG. 8 except taken along section XIII—XIII of FIG. 7.
Figure 14:
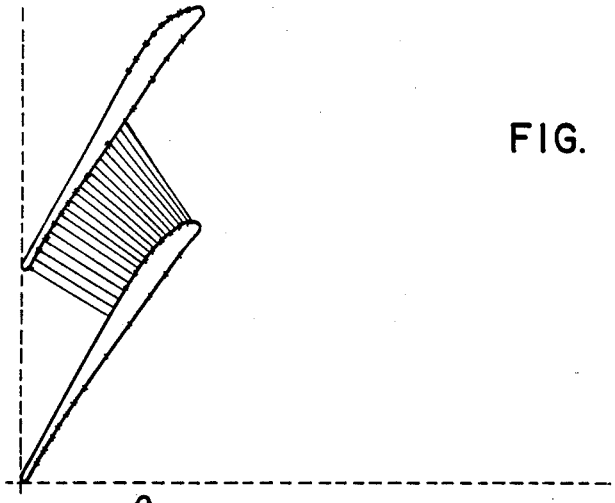
FIG. 14 is a plane slice view similar to FIG. 8 except taken along section XIV—XIV of FIG. 7.
Figure 15:
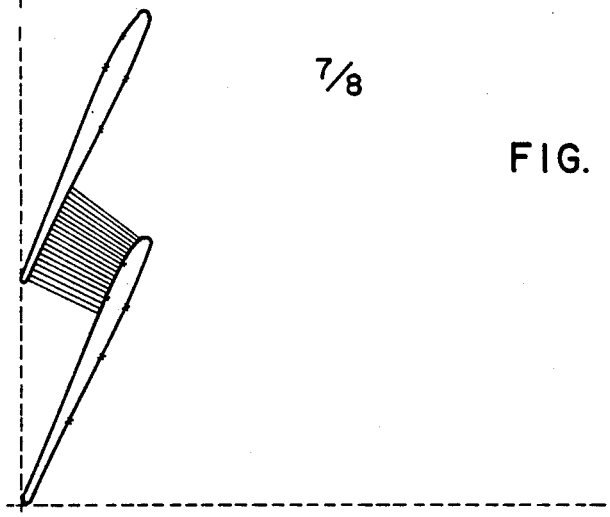
FIG. 15 is a plane slice view similar to FIG. 8 except taken along section XV —XV of FIG. 7.
Figure 16:
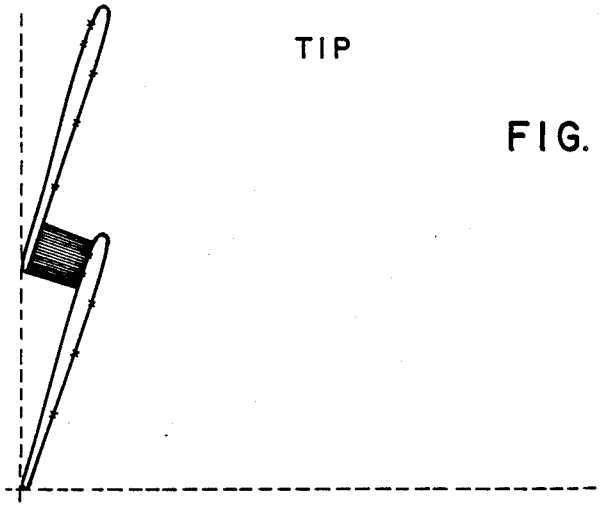
FIG. 16 is a plane slice view similar to FIG. 8 except taken along section XVI—XVI of FIG. 7.

FIG. 9 illustrates the next successive plane slice through two adjacent retrofitted rotor blades. The plane slices of FIG. 7 are equidistantly spaced from the base slice VIII—VIII to the tip slice XVI—XVI. Each plane slice shown in FIGS. 8–16 is defined by a series of coordinate points connected by a smooth continuous or curvilinear curve generated by spline interpolation. The coordinate points, represented in the drawings as small "x's", were chosen to satisfy the flow field requirements on the one hand and help raise the resonant frequencies on the other. The airfoil surfaces between each transverse, plane slice is a ruled surface generated by a series of straight lines connecting like numbered coordinate points at each slice. The junction of the surfaces at each slice is blended by a constant radius tangent to each of the intersecting lines. The surface areas between two adjacent plane slices, such as between slices VIII—VIII of FIG. 8 and IX—IX of FIG. 9 defines an airfoil section. Between the base slice and the tip slice, there are eight airfoil sections of equal length. FIGS. 8–16 are labeled to correspond to a particular section. Since the base slice does not define a section, FIG. 8 is simply labeled the "base". The area between the base slice (FIG. 8) and the next successive slice (FIG. 9) defines the first of eight sections; therefore, FIG. 9 is labeled the "$\frac{1}{8}$" section. This follows for FIGS. 10–15 and the corresponding $\frac{1}{4}$ through $\frac{7}{8}$ sections, and FIG. 16 which is labeled the "tip" section.

In order to increase resonant frequency of the retrofitted rotor blade, the sections nearest the base slice VIII—VIII were increased in width, while the sections nearest to and including the tip slice XVI—XVI were narrowed. Adding width to the base and narrowing the tip sections has the advantage of increasing the frequency in the second mode of vibration, with little or no effect on the first and fourth modes of vibration. This is important since other tuning techniques increase the first mode but decrease the second.

As a result of using a combination of tuning and designing techniques, an airfoil portion having longer length was achieved without lowering resonant frequencies. The airfoil portion 36 shown in FIG. 7 is a compilation of nine plane slices having an arrangement of perfectly stacked centers of gravity for each of the nine sections. This perfect balancing eliminates eccentricities between the sections which decreases performance. While it is generally required to maintain the centers of gravity for all sections to within one thirty second (1/32) of an inch, perfect stacking of centers of gravity has been previously unobtainable. Perfect stacking requires a sufficient number of plane slices, such as nine. It is also important that, once a relatively large number of plane slices is taken, the sections must be re-designed successively outwardly beginning at the base and ending at the tip. "Filling-in" or interpolating between far apart sections is believed to lead to eccentricities.

In FIGS. 8–14, most of the pressure-side surfaces are concave and the vacuum-side surfaces are convex. However, the $\frac{7}{8}$ and tip sections (FIGS. 15 and 16) have double-convex surfaces so that, in effect, both the pressure-side (which is normally concave) and the vacuum-side (which is normally convex) are convex. This reverse curvature of the $\frac{7}{8}$ and tip sections accommodates the new flow field and increases thermal performance.

Referring to FIGS. 2–7, wires 44 and 46 are used to lash together a group of retrofitted rotor blades. The number of rotor blades in a group has an effect on the natural resonant frequency of the blades, particularly in the third mode of vibration. The position of the lashing wires 44 and 46, as well as the dimensions or thickness of the lashing wires, also has an effect on the resonant frequencies. While moving the lower wire 44 downwardly tends to increase the frequency of the first mode, the same operation decreases the frequency in the second mode. The third mode, as previously mentioned, is affected mostly by the number of blades in a particular grouping. The fourth mode is most heavily influenced by the position of the outer or second wire 46. The lower lashing wire 44 has been found to have a strong influence on the first mode of vibration. Moving the lower lashing wire 44 downwardly has the desired effect of increasing the natural resonant frequency for the first mode of vibration. Unfortunately, moving the lower wire 44 downwardly also decreases the natural resonant frequency in the second mode of vibration. This tends to limit the effectiveness of wire positioning as a blade tuning technique.

The present invention incorporates a unique combination of interrelated tuning techniques for retrofitted rotor blades having lashing wires. For instance, widening the lower sections and narrowing the upper sections increases the second and third modes of vibration while having little or no effect on the first and fourth modes. This works well in combination with moving the lower lashing wire 44 downwardly since this movement decreases the second mode frequency. Also, the retrofitted rotor blade shown in FIGS. 2–7 has a profiled tip 42 (shown in detail in FIG. 3). The profiled tip 42 represents a removal of mass from the tip. Frequency testing reveals that tip profiling has a disproportionate increasing effect on the natural resonant frequency for the second mode of vibration.

Widening the base section and one or more of the lower sections next to the base section, in conjunction with narrowing the tip sections and at least one section next to the tip has the effect of increasing the stiffness of the blade for tuning purposes. The widened sections may include half the airfoil portion. The tapering, which becomes progressively narrower towards the tip, controls centrifugal stresses on the blade and maintains structural integrity.

A method of making a retrofitted rotor blade according to the present invention includes designing a basic airfoil shape for the retrofitted rotor blade based on flow field parameters. This can be done by a computer programmed to generate a basic airfoil shape based on flow field parameters. The basic airfoil shape, generated by computer program or manually, is then modified by manipulating points along plane slices to maintain convergence from the leading edge to the trailing edge and also to ensure that minimum thickness requirements are met. In the process of modifying the basic shape, nine plane slices are preferably taken and the shape of each slice is modified as needed. Modification of the plane slices begins at the base slice and proceeds successively towards the tip. By so doing, the resulting rotor blade achieves perfectly stacked centers of gravity for each airfoil section. The modified basic shape is further modified in the tuning process, in which the tip of the rotor blade is profiled to reduce mass at the tip and to increase the resonant frequency of the blade in the second mode of vibration. Part of the tuning step involves moving the lower and upper lashing wires and widening in the axial direction the lower airfoil sections of the airfoil portion. The upper airfoil sections are narrowed in the axial direction to provide an overall tapering of width from base to tip. As a result of the tuning and modifying steps, all but the last two airfoil sections of the airfoil portion have concave pressure-side surfaces and opposite convex vacuum-side surfaces. The last two airfoil sections, including the tip section, have convex surfaces on both the pressure-side and the vacuum-side surfaces.

Numerous modifications and adaptations of the present invention will be apparent to those so skilled in the art and thus, it is intended by the following claims to cover all such modifications and adaptations which fall within the true spirit and scope of the invention.

What is claimed is:

1. A steam turbine rotor assembly, comprising:

a rotor rotatable at a predetermined running speed which determines a harmonic series of vibratory frequencies;

at least one row of retrofitted rotor blades mounted on the rotor and vibrating at running speed in a plurality of directions, each direction of vibration having a corresponding natural resonant frequency, and each retrofitted rotor blade having a length greater than that of the rotor blades which were originally designed for the same row;

a lower lashing wire and an upper lashing wire for lashing the retrofitted rotor blades together in groups of at least three adjacent retrofitted rotor blades per group, the upper and lower lashing wires extending between each two adjacent retrofitted rotor blades of a group;

each retrofitted rotor blade having a root portion of substantially the same size and shape as the original rotor blade, a platform portion, and an airfoil portion, the airfoil portion having a leading edge, a trailing edge, a pressure-side surface, a vacuum-side surface, a proximal end base, and a distal end tip, the configuration of the airfoil portion being defined in accordance with a plurality of equidistantly spaced plane slices transverse to the length thereof beginning at the base and ending at the tip, the area between two adjacent plane slices defining a plurality of sections, each having a center of gravity, the centers of gravity for all sections being vertically aligned;

the lower lashing wires of the retrofitted rotor blades being positioned to tune the resonant frequency of the blades with respect to one of the vibrational directions and the upper lashing wire being positioned to tune the resonant frequency of the rotor blade with respect to another of the vibrational directions, the lower lashing wire of the retrofitted rotor blades having an increased thickness compared to the lower wire of the original rotor blades;

at least one of the sections of the airfoil portion of the retrofitted rotor blade nearest the root having an increased width compared to correspondingly located sections of the original rotor blade, at least one of the sections of the airfoil portion of the retrofitted rotor blade nearest the distal end tip having a decreased width compared to correspondingly located sections of the original rotor blade;

the distal end tip of the retrofitted rotor blade being profiled;

the section next to the distal end tip of the airfoil portion of each retrofitted rotor blade and the section adjacent thereto having pressure-side and vacuum-side surfaces which are convex, and the remaining sections having concave pressure-side surfaces and convex vacuum-side surfaces; and the position and thickness of the lower lashing wire, the number of blades in a lashed group, the width of the airfoil sections, and the profiling of the tip combining to increase the rotor blade natural resonant frequencies for the plurality of vibrational directions to frequency levels which fall between, but not in proximity to, the frequencies of the harmonic series, thereby compensating for a decrease in resonant frequency associated with the lengthening of the retrofitted rotor blade.

2. A steam turbine rotor assembly according to claim 1, wherein the retrofitted rotor blades vibrate in at least four different directions at a minimum of seven different corresponding natural resonant frequencies, the at least four different natural resonant frequencies for the retrofitted rotor blades approximating the four corresponding natural resonant frequencies of the original rotor blades.

3. A steam turbine rotor assembly according to claim 1, wherein the plurality of equidistantly spaced plane slices comprise nine plane slices starting at the base of the airfoil portion and extending in equidistantly spaced intervals up to the tip of the airfoil portion, the area between each two adjacent plane slices defining eight sections of the airfoil portion, each having a center of gravity.

4. A steam turbine rotor assembly according to claim 1, wherein each grouping of retrofitted rotor blades includes three retrofitted rotor blades.

5. A steam turbine rotor assembly according to claim 4, wherein the total number of retrofitted rotor blades in the row comprises 120.

6. A method of making a retrofitted rotor blade for a steam turbine, the rotor blade being one of a plurality of identical rotor blades arranged in a row and mounted to a rotor, the plurality of rotor blades being lashed together in groups of at least three, each rotor blade having a root portion, a platform portion and an airfoil portion, the airfoil portion having a leading edge, a trailing edge, a proximal end base, a distal end tip, a pressure-side surface and an opposite vacuum-side surface, the method comprising:

designing a basic airfoil shape for the retrofitted rotor blade based on flow field parameters including inlet and outlet angles, gauging, and velocity ratio;

modifying the basic shape of the airfoil portion in successive sections from the base to the tip so that for every two adjacent rotor blades, the pressure-side surface of one blade converges with the vacuum-side surface of the other blade from the leading edge to the trailing edge, each two adjacent plane slices defining an airfoil section having a center of gravity, the centers of gravity for all airfoil sections being vertically aligned; and tuning the retrofitted rotor blade to increase the resonant frequency for a plurality of modes of vibration by profiling the tip of the rotor blade, moving the lashing wires outwardly towards the tip, widening the lower airfoil sections of the airfoil portion, and reducing the thickness of the upper airfoil sections;

all but the last two airfoil sections of the airfoil portion having concave pressure-side surfaces and opposite convex vacuum-side surfaces, with the last two airfoil sections having convex pressure-side surfaces and opposite convex vacuum-side surfaces.

7. A method of making a retrofitted rotor blade according to claim 7, wherein the modified step further comprises:

dividing the airfoil portion into at least nine equidistantly spaced plane slices beginning with a base slice and ending with a tip slice, each plane slice having an outer boundary, and altering the outer boundary for each plane slice beginning with the base and proceeding successively to the tip so that opposing surfaces between two adjacent rotor blades of a row having converging surfaces from the leading edge to the trailing edge.

* * * * *